US007881635B2

(12) United States Patent
Yamazoe et al.

(10) Patent No.: US 7,881,635 B2
(45) Date of Patent: Feb. 1, 2011

(54) IMAGE FORMING APPARATUS INCLUDING A DETACHABLE CONVEY-GUIDING MEMBER DETACHABLY ATTACHED TO A FIXED CONVEY-GUIDING MEMBER FIXED TO A DEVICE MAIN BODY

(75) Inventors: Yoshikazu Yamazoe, Osaka (JP); Yutaka Naito, Hyogo (JP); Yasunobu Ogata, Osaka (JP); Shin Yamamoto, Osaka (JP)

(73) Assignee: Ricoh Company, Limited, Tokyo (JP)

( * ) Notice: Subject to any disclaimer, the term of this patent is extended or adjusted under 35 U.S.C. 154(b) by 420 days.

(21) Appl. No.: 12/068,979

(22) Filed: Feb. 14, 2008

(65) Prior Publication Data

US 2008/0193162 A1 Aug. 14, 2008

(30) Foreign Application Priority Data

Feb. 14, 2007 (JP) ..... 2007-033542

(51) Int. Cl.
*G03G 15/08* (2006.01)
*G03G 21/00* (2006.01)
*G03G 15/00* (2006.01)

(52) U.S. Cl. ..... 399/121; 399/124; 399/125

(58) Field of Classification Search ..... 399/110, 399/121, 124, 125
See application file for complete search history.

(56) References Cited

U.S. PATENT DOCUMENTS 5,787,326 A * 7/1998 Ogawa et al. ..... 399/124
7,031,638 B2 * 4/2006 Tanizaki et al. ..... 399/112
7,130,561 B2 * 10/2006 Iikura et al. ..... 399/111
7,706,719 B2 * 4/2010 Kiyama ..... 399/110
2006/0127130 A1 * 6/2006 Komoda et al. ..... 399/124

FOREIGN PATENT DOCUMENTS

| | | |
|---|---|---|
| JP | 07-199768 | 8/1995 |
| JP | 2872852 | 1/1999 |
| JP | 2000-105493 | 4/2000 |
| JP | 2000-231271 | 8/2000 |
| JP | 3340545 | 8/2002 |
| JP | 2002-278414 | 9/2002 |
| JP | 2002-348018 | 12/2002 |
| JP | 3377595 | 12/2002 |
| JP | 3439732 | 6/2003 |
| JP | 2004-205534 | 7/2004 |
| JP | 2005-266157 | 9/2005 |
| JP | 3954431 | 5/2007 |

* cited by examiner

*Primary Examiner*—David M Gray
*Assistant Examiner*—Joseph S Wong
(74) *Attorney, Agent, or Firm*—Harness, Dickey & Pierce, P.L.C.

(57) ABSTRACT

An intermediate transfer unit can be detached from a device main body through an opening that is covered by an openable and closable front cover. A sheet path is provided between the intermediate transfer unit and the front cover. A portion of a convey-guiding unit of the sheet path falls in the way when detaching the detachable intermediate transfer unit. The portion of the convey-guiding unit, which falls in the way when detaching the detachable intermediate transfer unit, is formed as a detachable convey-guiding member that is detachably attached to the device main body.

16 Claims, 5 Drawing Sheets

IMAGE FORMING APPARATUS INCLUDING A DETACHABLE CONVEY-GUIDING MEMBER DETACHABLY ATTACHED TO A FIXED CONVEY-GUIDING MEMBER FIXED TO A DEVICE MAIN BODY

CROSS-REFERENCE TO RELATED APPLICATIONS

The present application claims priority to and incorporates by reference the entire contents of Japanese priority document 2007-033542 filed in Japan on Feb. 14, 2007.

BACKGROUND OF THE INVENTION

1. Field of the Invention

The present invention relates to an image forming apparatus.

2. Description of the Related Art

In development of an image forming apparatus, enhancing compactness of the image forming apparatus has become an important task. To obtain a compact image forming apparatus, arranging components effectively is necessary. In other words, effective use of the space inside the image forming apparatus is necessary.

Japanese Patent Application Laid-open No. 2004-205534 discloses a technique to achieve effective use of the space inside an image forming apparatus. In this image forming apparatus, a unit, such as a conveying unit, is attached to an openable and closable door. Moreover, a sheet path opens on opening of the door, thereby enabling to easily take-out a jammed sheet. Furthermore, various units can be removed for replacement or maintenance just by opening the door.

In the image forming apparatus disclosed in Japanese Patent Application Laid-open No. 2004-205534, while removing an internal unit, for example, an intermediate transfer unit, a guiding plate of the sheet path can fall in the way of the intermediate transfer unit. To avoid the guiding plate being falling in the way of the intermediate transfer unit at the time of removal, one approach could be to fix the guiding plate to the rotatable door. If the guiding plate is fixed to a moving part, such as the rotatable door, the position of the guiding plate is likely to be displaced from a normal position every time the door is opened or closed, thereby leading to lowered positioning accuracy.

SUMMARY OF THE INVENTION

It is an object of the present invention to at least partially solve the problems in the conventional technology.

According to an aspect of the present invention, there is provided an image forming apparatus that includes an intermediate transfer unit that is detachable from a device main body through an opening, the opening being covered by an openable and closable opening closing member with a sheet path being provided between the intermediate transfer unit and the opening closing member, and a portion of a convey-guiding unit of the sheet path falls in the way of the detachable intermediate transfer unit. The portion of the convey-guiding unit is formed as a detachable convey-guiding member that is configured so as to be detachably attached to the device main body.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
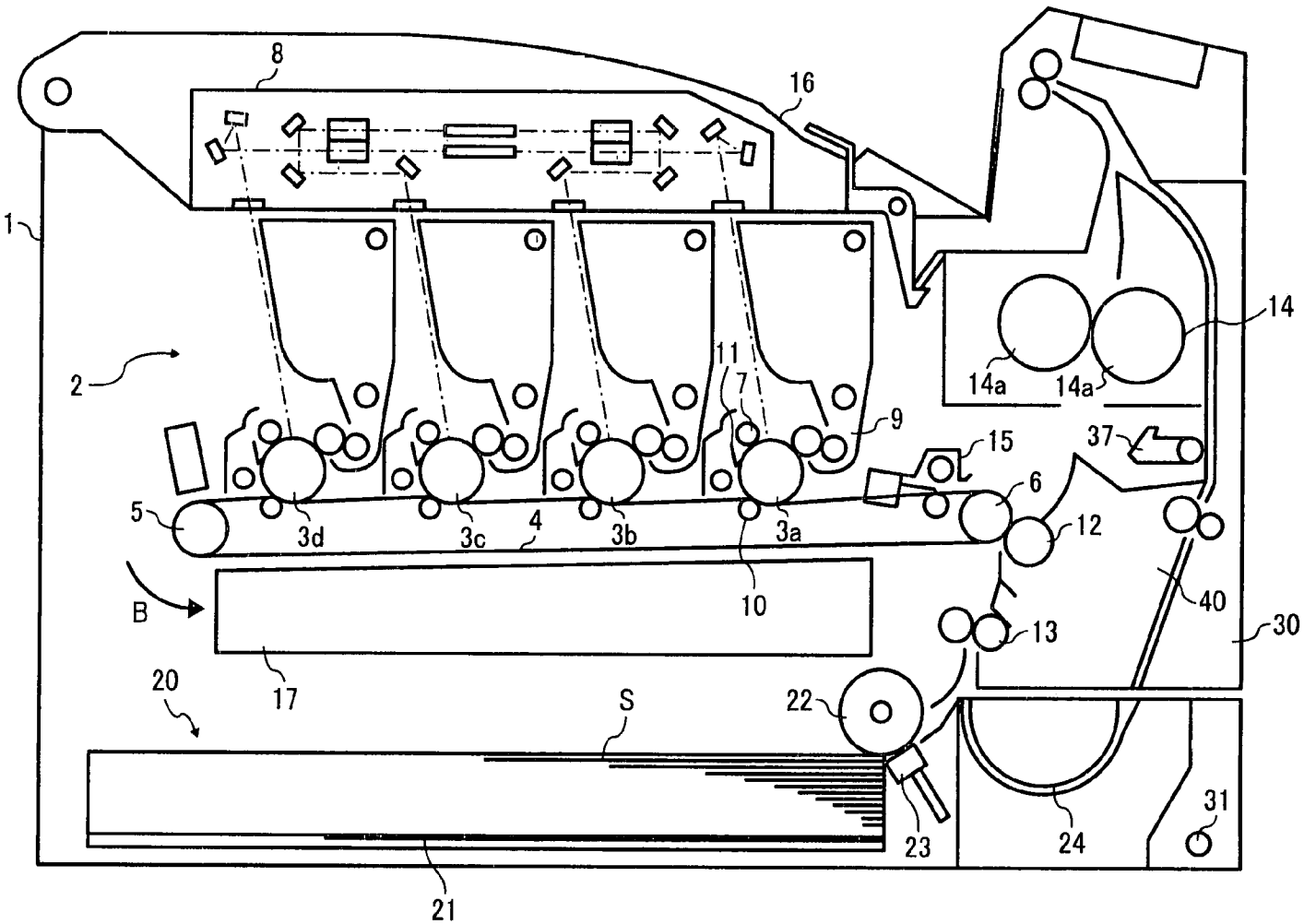
FIG. 1 is a schematic of an image forming apparatus according to an embodiment of the present invention.

FIG. 1 is a schematic of an overview of an image forming apparatus according to the present invention. An image forming unit 2 is arranged in substantially the center of a device main body 1 of the image forming apparatus. Moreover, a sheet feeder 20, which feeds a sheet on which an image is to be formed in the image forming unit 2, is arranged under the image forming unit 2.

The image forming unit 2 includes, as image carriers, a plurality of drum-shaped photosensitive bodies 3*a* to 3*d*. A toner image of a different color is formed on each of the photosensitive bodies 3*a* to 3*d*. Specifically, yellow toner image is formed on a surface of the photosensitive body 3*a*, cyan toner image is formed on a surface of the photosensitive body 3*b*, magenta toner image is formed on a surface of the photosensitive body 3*c*, and black toner image is formed on a surface of the photosensitive body 3*d*. The image forming apparatus is a tandem-type color image forming apparatus, i.e., the photosensitive bodies 3*a* to 3*d* are arranged parallel to each other at a predetermined gap. An intermediate transfer belt 4, as an intermediate transfer body, is arranged across the photosensitive bodies 3*a* to 3*d*. The intermediate transfer belt 4 is an endless belt and it is wound around a plurality of supporting rollers 5 and 6, and it is driven in a direction shown by an arrow B. A drum can be used as the intermediate transfer body instead of the intermediate transfer belt 4.

An electric charger 7 that electrically charges the surface of the photosensitive body 3, a light scanning unit (LSU) 8 that irradiates the surface of the photosensitive body 3 with a laser light in accordance with image data, a developing device 9 exposes an electrostatic latent image formed on the surface of the photosensitive body 3 thereby developing the electrostatic latent image into a visual image, a transferring device 10 arranged across the photosensitive body 3 via the intermediate transfer belt 4, and a cleaning device 11 that removes a toner left on the surface of the photosensitive body 3 after a transfer process is over are provided around the photosensitive bodies 3*a* to 3*d*.

Upon starting image forming in the image forming apparatus, the photosensitive bodies 3*a* to 3*d* rotate in a clockwise direction shown in FIG. 1 and the electric charger 7 charges the surfaces of the photosensitive bodies 3*a* to 3*d* to a predetermined polarity. Next, based on the image data, the laser light is irradiated from the LSU 8 on the charged surface of the photosensitive bodies 3*a* to 3*d*, thereby forming an electrostatic latent image on each of the photosensitive bodies 3*a* to 3*d*. The developing device 9 develops the electrostatic latent images into toner images, i.e., visual images, and the transferring device 10 transfers the toner images onto the intermediate transfer belt 4.

As a result, a yellow toner image, a cyan toner image, a magenta toner image, and a black toner image respectively formed on the photosensitive bodies 3*a* to 3*d* are sequentially transferred onto the intermediate transfer belt 4 and overlapped on each other. A secondary transfer roller 12 is arranged across the supporting roller 6 and the intermediate transfer belt 4 is sandwiched between the supporting roller 6 and the secondary transfer roller 12.

The sheet feeder 20, which is arranged under the image forming unit 2, includes a sheet feed tray 21, a sheet feeding roller 22, a friction pad 23, and a reconveying path 24. The sheet feed tray 21 is a sheet housing unit for stacking therein sheets S. The sheets S can be paper sheets or resin film sheets. The sheet feeding roller 22 is a feeding roller that picks-up one or more sheets S from the sheet feed tray 21. The friction pad 23 is a separating member that allows only one sheet out of the sheets picked-up by the sheet feeding roller 22 to pass downstream. The reconveying path 24 is a path that is used at the time of forming images on both sides of a sheet. For example, a reverse roller of a torque limiter system can be used as the separating member.

The sheet S picked-up from the sheet feeder 20 is sent in between a pair of registration rollers 13 that are not rotating. Because the registration rollers 13 are not rotating, the leading edge of the sheet S strikes to the registration rollers 13 and the sheet gets aligned, i.e., registered. Subsequently, the registration rollers 13 start rotating at a timing when a color toner image formed on the intermediate transfer belt 4 matches with the leading edge of the sheet S in a secondary transfer unit including the secondary transfer roller 12. Due to the rotation of the registration rollers 13, the aligned sheet S is sent towards the secondary transfer unit.

The sheet S on which an unfixed toner image is transferred in the secondary transfer unit is sent to a fixing device 14 including a pair of fixing rollers 14*a* and after the unfixed toner image is fixed onto the sheet S, the sheet S is ejected into a sheet loading unit 16 provided on an upper part of the device main body 1. Once the process of transferring the toner image is complete, the toner left on the surface of the intermediate transfer belt 4 is removed by a belt cleaner 15.

Figure 2:
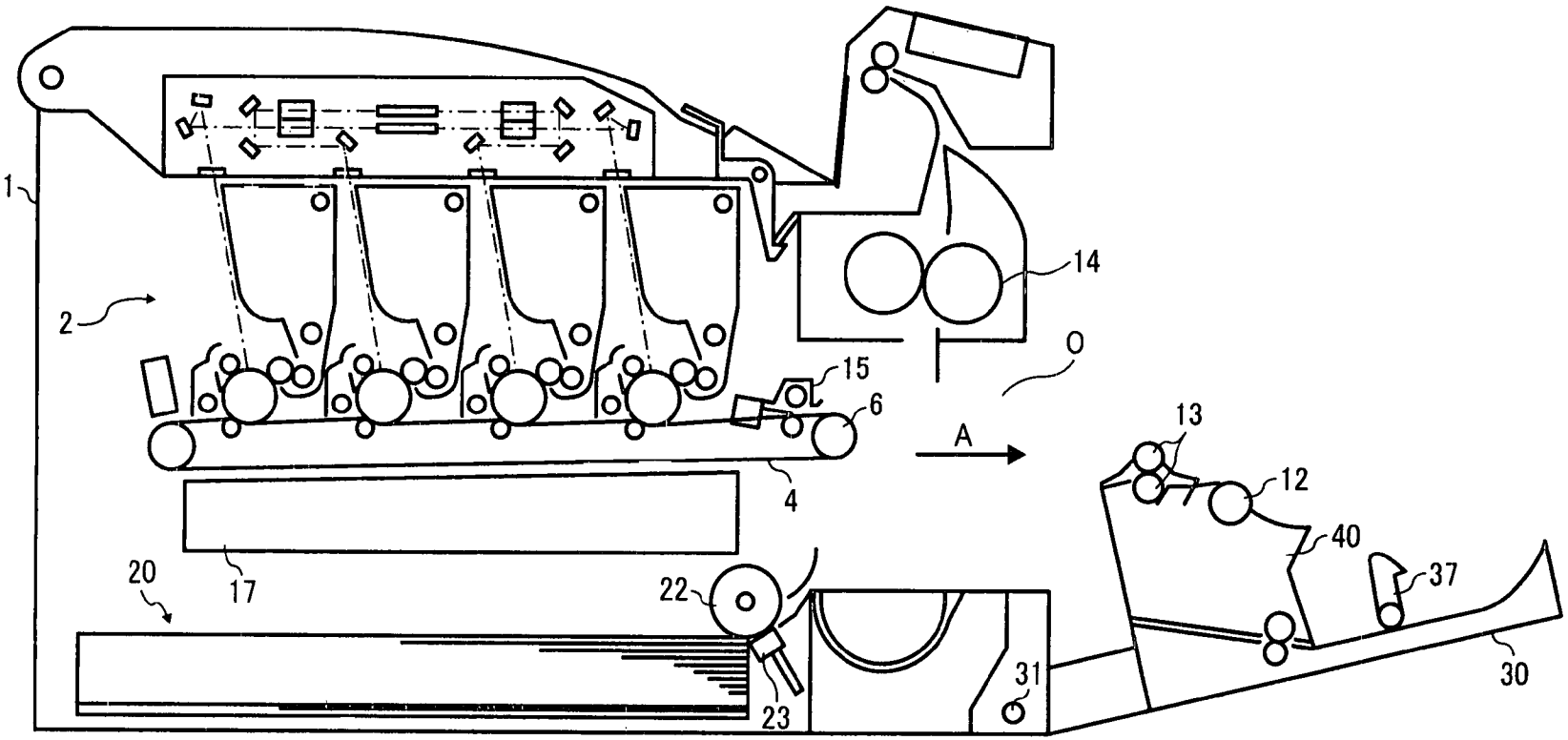
FIG. 2 is a schematic of an image forming apparatus shown in FIG. 1 with a front cover open.

The right side shown in FIG. 1 is a front face of a printer. A front frame of the device main body 1, in other words, a front cover 30, which is an opening closing member, can be opened and closed by pivoting on a supporting point 31. A closing position is shown in FIG. 1 and an opening position is shown in FIG. 2. Some components are fixed to the front cover 30. For example, a conveying unit 40 that conveys the sheet S picked-up from the sheet feeder 20 to the secondary transfer unit is fixed to the front cover 30. Specifically, the conveying unit 40 includes the registration rollers 13, the secondary transfer roller 12, and one guiding plate 25 of the reconveying path 24.

As shown in FIG. 2, maintenance of the intermediate transfer belt 4 or a waste toner tank 17 can be carried out by opening the front cover 30. From an opening O, the intermediate transfer belt 4 is slid along with the coupled cleaner 15 as one unit (hereinafter, called an intermediate transfer unit U) in the direction of an arrow A and is removed.

However, while removing the intermediate transfer unit U from the opening O, a portion of a convey-guiding unit falls in the way of the intermediate transfer unit U. If the portion of the convey-guiding unit is fixed to the front cover 30, by rotating the front cover 30, the portion of the convey-guiding unit is moved to the position such that the portion of the convey-guiding unit will not fall in the way of the intermediate transfer unit U. However, in such a structure, when the front cover 30 is returned back, a problem of a decline in the positioning accuracy of the convey-guiding unit mentioned earlier arises.

Figure 3:
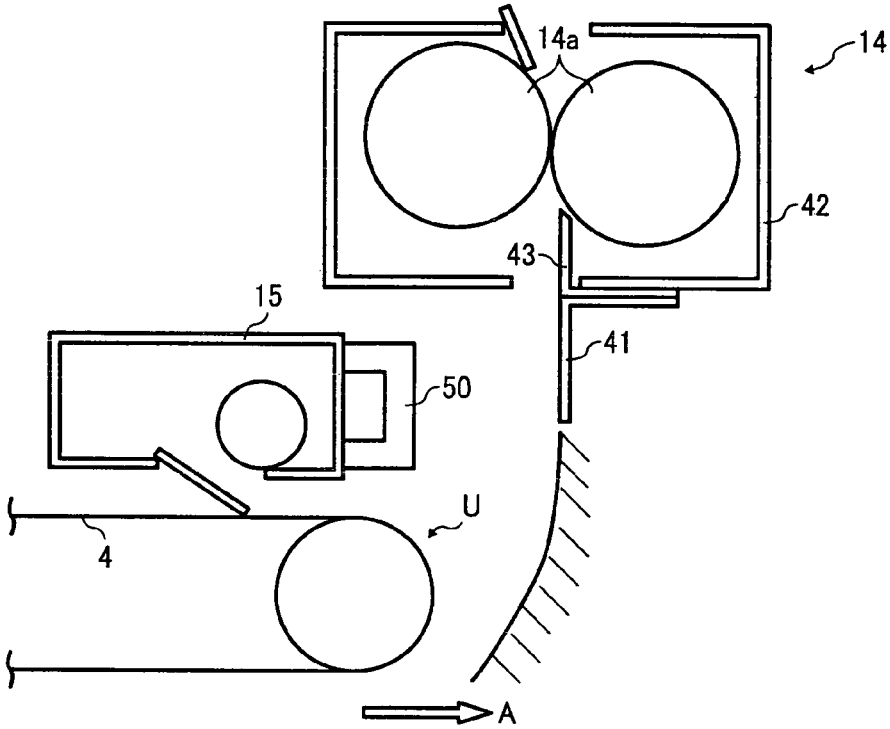
FIG. 3 is an enlarged schematic of an opening for removing an intermediate transfer unit.

To overcome the problem, following measures are taken in the present embodiment. That is, as shown in FIG. 3, a handle 50 is provided on an outer surface of the cleaner 15 and the intermediate transfer unit U can be slid in the direction of the arrow A and can be removed from the device main body 1 by pulling the handle 50. Even if the front cover 30 is wide open, a portion of the convey-guiding unit is at a position where it hinders the operation of the handle.

To take care of this issue, the portion of the convey-guiding unit, which hinders the operation of the handle, is formed as a detachable convey-guiding member 41 that can be easily attachable to and detachable from the device main body 1. The detachable convey-guiding member 41 is detachably attached to a fixed convey-guiding member 43 that is firmly fixed to a casing 42 of the fixing device 14.

Figure 4:
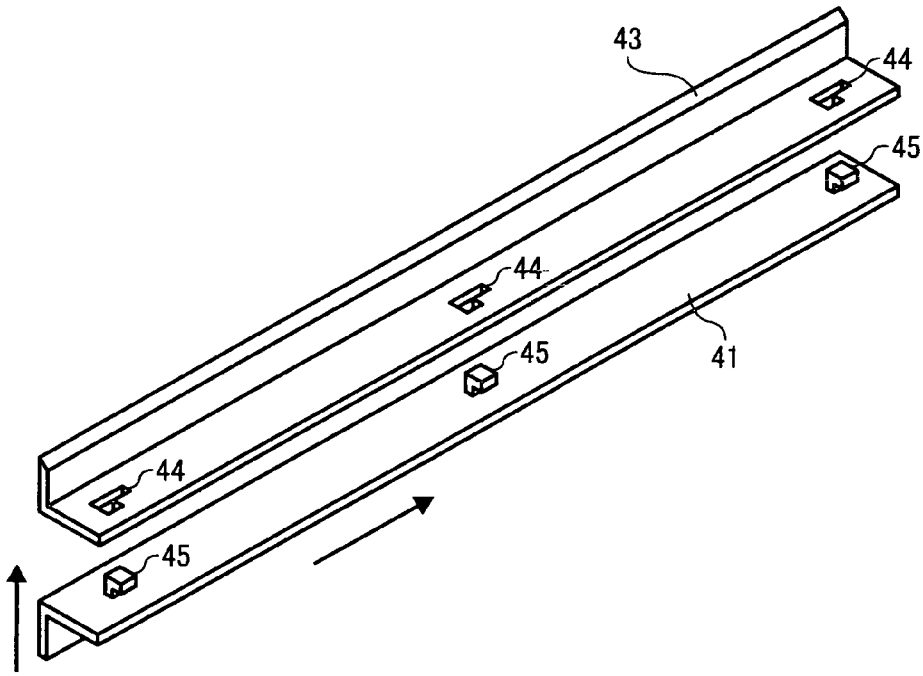
FIG. 4 is a perspective of a detachable convey-guiding member and a fixed convey guiding member.
Figure 5:
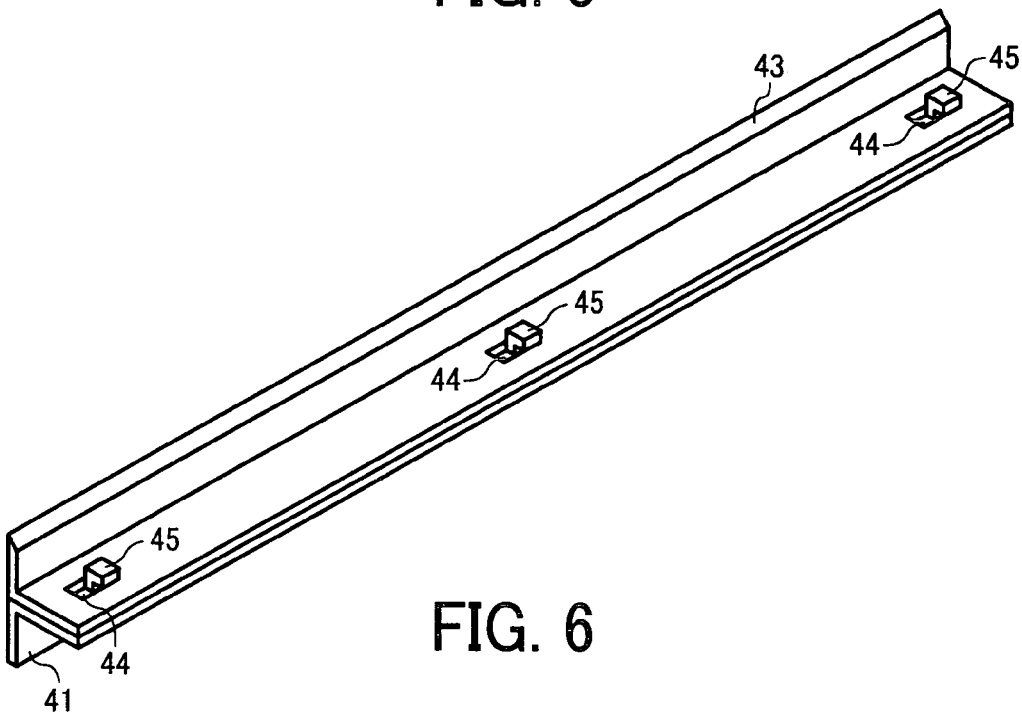
FIG. 5 is a perspective of the detachable convey-guiding member and the fixed convey-guiding member fixed to each other.

FIGS. 4 and 5 are perspectives of concrete examples of the detachable convey-guiding member 41 and the fixed convey-guiding member 43. In FIG. 4 the detachable convey-guiding member 41 and the fixed convey-guiding member 43 are shown to be detached from each other, while in FIG. 5 they are shown to be attached to each other. Each of the detachable convey-guiding member 41 and the fixed convey-guiding member 43 has L-shaped cross-section. Moreover, each of the detachable convey-guiding member 41 and the fixed convey-guiding member 43 is in the form of a plate extended across the width of the sheet path.

Figure 6:
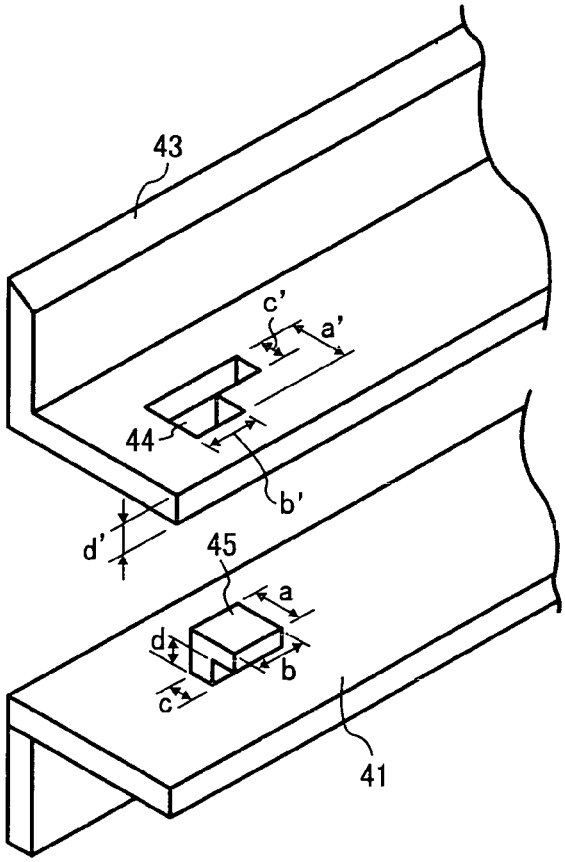
FIG. 6 is an enlarged perspective for explaining convex and concave members of the detachable convey-guiding member and the fixed convey guiding member shown in FIG. 4.

Three L-shaped fitting holes 44, as concave members, are formed in the fixed convey-guiding member 43. On the other hand, three L-shaped projections 45, as convex members, are arranged at positions corresponding to the fitting holes 44 on the detachable convey-guiding member 41. As shown in FIG. 6, the fitting holes 44 of the fixed convey-guiding member 43 and the projections 45 of the detachable convey-guiding member 41 are set by respectively setting a width a to a width a', a width b to a width b', a thickness c to a width c' of a narrow portion, and a height d of a bending surface to a thickness d' of a same size or a marginally wider size.

As shown in FIG. 5, the detachable convey-guiding member 41 is fixed to the fixed convey-guiding member 43. When removing the detachable convey-guiding member 41 from the fixed convey-guiding member 43, the detachable convey-guiding member 41 is slightly moved to a left side shown in FIG. 6 and after horizontal plate portions of the projections 45 are matched with wider portions of the fitting holes 44, the detachable convey-guiding member 41 can be pulled down and removed. As a result, the detachable convey-guiding member 41 detaches from the fixed convey-guiding member 43 as shown in FIG. 4. On the other hand, the detachable convey-guiding member 41 can be fixed (engaged or coupled) to the fixed convey-guiding member 43 by a reversed operation. In other words, the horizontal plate portions of the projections 45 of the detachable convey-guiding member 41 are respectively matched with the wider portions of the fitting holes 44. After the projections 45 are inserted into the fitting holes 44 by pushing the projections 45 up and if moved to a right side shown in FIG. 6, the detachable convey-guiding member 41 is fixed to the fixed convey-guiding member 43 that is shown in FIG. 5.

In this manner, the detachable convey-guiding member 41 can be attached to and detached from the fixed convey-guiding member 43 by simple operations. Therefore, without detaching another unit and a member from the device main body 1, the intermediate transfer unit U can be detached from the device main body 1 by minimum operations.

The direction along which the detachable convey-guiding member 41 moves when attaching it to or detaching it from the device main body 1 is nearly perpendicular to the direction of movement of a sheet in the sheet path. As a result, at the time of conveying the sheet, especially, due to a heavy sheet, a load direction with respect to the detachable convey-guiding member 41 is different from a attaching direction to the device main body 1, thereby enabling to secure a stable convey guiding position. Furthermore, the similar load received when jamming on the convey guide occurs or when removing a jammed paper can be avoided.

Although the mechanism for fixing the detachable convey-guiding member 41 to the fixed convey-guiding member 43 is simple, i.e., an assembly of convex and concave members, the detachable convey-guiding member 41 can be fixed easily and firmly. Moreover, because the convex member is arranged on the detachable convey-guiding member 41, which is attachable and detachable, there are no projecting members on the fixed convey-guiding member 43, which is left in the device main body 1 at the time of attaching and detaching the intermediate transfer unit U, so that a detaching space of the intermediate transfer unit U can be easily secured.

It is preferable that the detachable convey-guiding member 41 be made from transparent resin material. If the detachable convey-guiding member 41 is transparent, fitting of convex and concave members can be visually confirmed at the time of detaching and/or attaching operation so that the detaching and/or attaching operation can be easily carried out. Furthermore, if jamming occurs in the guiding unit, the jammed sheet is clearly visible so that it can be taken out easily.

Figure 7:
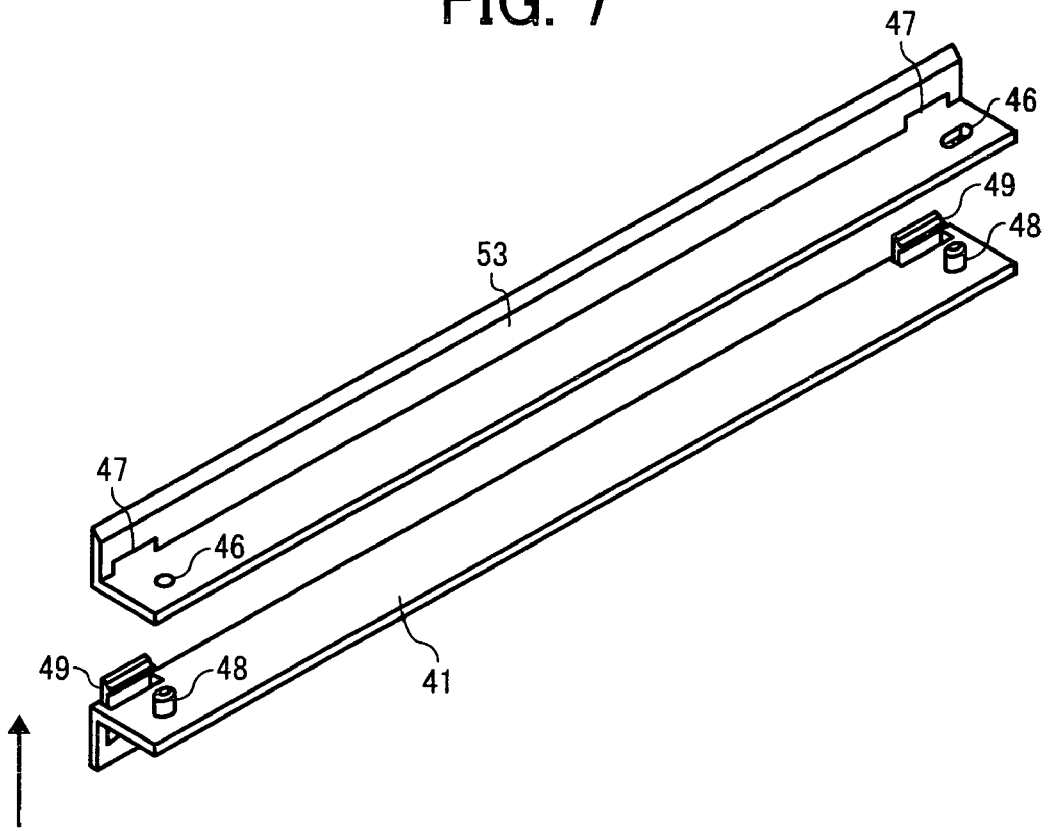
FIG. 7 is a perspective of a detachable convey-guiding member and a fixed convey-guiding member according to another embodiment.
Figure 8:
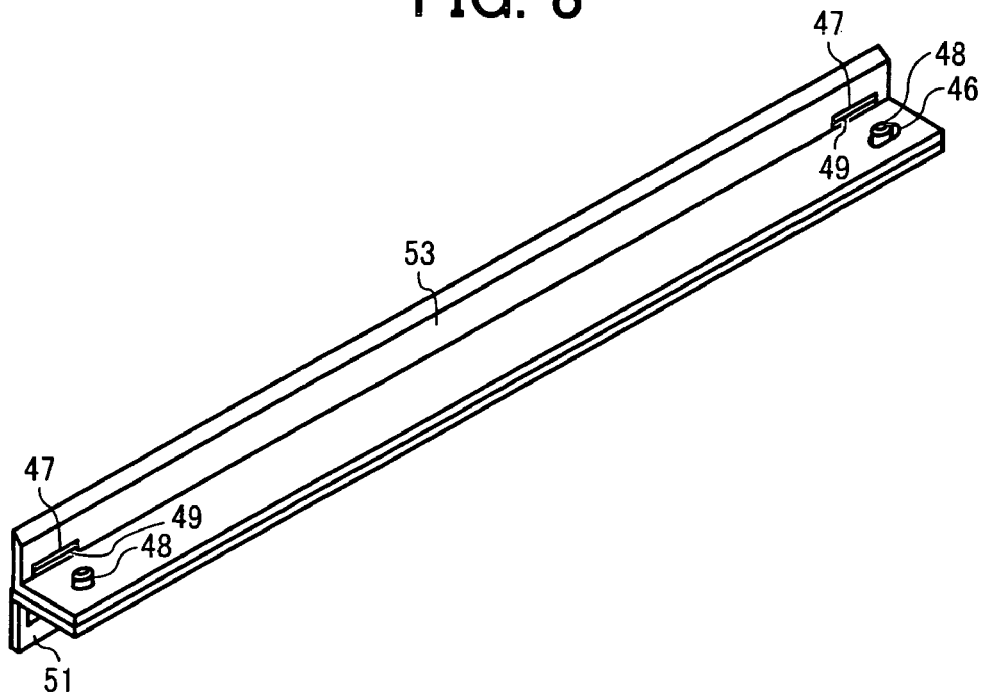
FIG. 8 is a perspective of the detachable convey-guiding member and the fixed convey-guiding member shown in FIG. 7 fixed to each other.

FIGS. 7 and 8 are perspectives of another concrete example of a detachable convey-guiding member 51 and a fixed convey-guiding member 53. In FIG. 7 the detachable convey-guiding member 51 and the fixed convey-guiding member 53 are shown to be detached from each other, while in FIG. 8 they are shown to be attached to each other. Each of the detachable convey-guiding member 51 and the fixed convey-guiding member 53 has L-shaped cross-section. Moreover, each of the detachable convey-guiding member 51 and the fixed convey-guiding member 53 is in the form of a plate extended across the width of the sheet path.

Two holes 46, as concave members, are formed in the fixed convey-guiding member 53, and two slits 47 are formed at the corner of the L-shape. On the other hand, two pins 48, as convex members, are formed on the detachable convey-guiding member 41, and two locking claws 49 are formed at the corner of the L-shape. The diameters of the pins 48 and the holes 46 are such that the pins 48 fit into the holes 46. Moreover, the dimensions of the claws 49 and the slits 47 are such that the claws 49 fit into the slits 47. One of the right and the left holes 46, in the example, the hole 46 on the right side is formed as a long hole that is extended in a longitudinal direction of the member, thereby simplifying fitting. Furthermore, at least detachable convey-guiding member 51 is made from a resin material that can be appropriately bent.

Thus, the pins 48 are coupled to the holes 46 and by pushing the detachable convey-guiding member 51 up, the slits 47 are fitted to the locking claws 49 by bending the resin, thereby, fixing the detachable convey-guiding member 41 to the fixed convey-guiding member 53.

Thus, by a one-touch operation using a snap-fit, the detachable convey-guiding member 51 can be fixed to the fixed convey-guiding member 53.

As explained above, the detachable convey-guiding member 41 (51) is to be attached to the fixed convey-guiding member 43 (53) that is provided in the sheet path and that is fixed to the device main body 1. Thus, unevenness and a gap on the sheet path can be minimized and guide positioning accuracy can be secured.

Because the fixed convey-guiding member 43 (53) is fixed to the fixing device 14, by detaching the fixing device 14, three points including the unit can be simultaneously detached from the device main body 1.

Furthermore, at the time of attaching the detachable convey-guiding member 41 (51), the intermediate transfer unit U cannot be removed. When trying to remove the intermediate transfer unit U by keeping the detachable convey-guiding member 41 (51) attached, damage of the detachable convey-guiding member 41 (51) can be prevented.

According to an embodiment of the present invention, a detachable convey-guiding member can be attached and detached by simple operations. Thus, without detaching another unit and a member from a device main body, an intermediate transfer unit can be detached from the device main body by required minimum operations and good positioning accuracy at the time of fixing can also be obtained.

A detaching direction of the detachable convey-guiding member that is detachably attached to the device main body is a nearly perpendicular direction with respect to a sheet direction of a sheet path. Thus, at the time of conveying a sheet, especially, due to a heavy sheet, a load direction with respect to the detachable convey-guiding member can be different from an attaching direction to the device main body, thereby enabling to secure a stable convey guiding position. Furthermore, the similar load received when jamming on the convey guide occurs or when removing a jammed paper can be avoided.

By using a convex member and a concave member for fitting the detachable convey-guiding member and a fixed convey guiding member to each other, more simplified structure can be obtained, thereby enabling to secure a stable position for the detachable convey-guiding member. By arranging the convex member on the detachable convey-guiding member, there will not be any protruding members on the fixed convey-guiding member, which is left on the device main body side at the time of attaching and detaching the intermediate transfer unit, so that a detaching space of the intermediate transfer unit can be easily secured.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus includes an intermediate transfer unit that is detachable from a device main body through an opening, the opening being covered by an openable and closable opening closing member with a sheet path being provided between the intermediate transfer unit and the opening closing member, and a portion of a convey-guiding unit of the sheet path falls in the way of the detachable intermediate transfer unit, wherein the portion of the convey-guiding unit is formed as a detachable convey-guiding member that is configured so as to be detachably attached to the device main body, wherein the detachable convey-guiding member can be detached in a nearly perpendicular direction with respect to a sheet direction of the sheet path, a fixed convey-guiding member that is a part of the sheet path and that is fixed to the device main body, and the detachable convey-guiding member is detachably attached to the fixed convey-guiding member.

2. The image forming apparatus according to claim 1, wherein the detachable convey-guiding member is detachably attachable to the device main body with a convexo-concave mechanism.

3. The image forming apparatus according to claim 2, wherein the convexo-concave mechanism includes a convex member arranged on the detachable convey-guiding member and concave member arranged on the device main body.

4. The image forming apparatus according to claim 1, wherein the detachable convey-guiding member made from a transparent material.

5. The image forming apparatus according to claim 1, wherein the detachable convey-guiding member is detachably attached to the fixed convey-guiding member with a convexo-concave mechanism, and the image forming apparatus further comprising a guiding member arranged on an upstream of a sheet conveying direction and the guiding member is formed in a convex shape.

6. The image forming apparatus according to claim 1, wherein the fixed convey-guiding member is integrally fixed to a fixing device that is detachably attachable to the device main body.

7. The image forming apparatus according to claim 5, wherein the fixed convey-guiding member is integrally fixed to a fixing device that is detachably attachable to the device main body.

8. The image forming apparatus according to claim 1, wherein the detachable convey-guiding member is operative to occlude a handle operated while detaching the intermediate transfer unit from the device main body.

9. An image forming apparatus includes an intermediate transfer unit that is detachable from a device main body through an opening, the opening being covered by an openable and closable opening closing member with a sheet path being provided between the intermediate transfer unit and the opening closing member, and a portion of a convey-guiding unit of the sheet path falls in the way of the detachable intermediate transfer unit, wherein the portion of the convey-guiding unit is formed as a detachable convey-guiding member that is configured so as to be detachably attached to the device main body, wherein the detachable convey-guiding member is detachably attachable to the device main body with a convexo-concave mechanism, and a fixed convey-guiding member that is a part of the sheet path and that is fixed to the device main body, and the detachable convey-guiding member is detachably attached to the fixed convey-guiding member.

10. The image forming apparatus according to claim 9, wherein the detachable convey-guiding member is detachably attached to the fixed convey-guiding member with a convexo-concave mechanism, and the image forming apparatus further comprising a guiding member arranged on an upstream of a sheet conveying direction and the guiding member is formed in a convex shape.

11. The image forming apparatus according to claim 9, wherein the convexo-concave mechanism includes a convex member arranged on the detachable convey-guiding member and concave member arranged on the device main body.

12. The image forming apparatus according to claim 9, wherein the detachable convey-guiding member made from a transparent material.

13. An image forming apparatus includes an intermediate transfer unit that is detachable from a device main body through an opening, the opening being covered by an openable and closable opening closing member with a sheet path being provided between the intermediate transfer unit and the opening closing member, and a portion of a convey-guiding unit of the sheet path falls in the way of the detachable intermediate transfer unit, wherein the portion of the convey-guiding unit is formed as a detachable convey-guiding member that is configured so as to be detachably attached to the device main body, a fixed convey-guiding member that is a part of the sheet path and that is fixed to the device main body, and the detachable convey-guiding member is detachably attached to the fixed convey-guiding member.

14. The image forming apparatus according to claim 13, wherein the detachable convey-guiding member is detachably attached to the fixed convey-guiding member with a convexo-concave mechanism, and the image forming apparatus further comprising a guiding member arranged on an upstream of a sheet conveying direction and the guiding member is formed in a convex shape.

15. The image forming apparatus according to claim 14, wherein the fixed convey-guiding member is integrally fixed to a fixing device that is detachably attachable to the device main body.

16. The image forming apparatus according to claim 13, wherein the fixed convey-guiding member is integrally fixed to a fixing device that is detachably attachable to the device main body.

* * * * *